United States Patent [19]

Mowbray

[11] 4,140,095

[45] Feb. 20, 1979

[54] LIQUID FUEL PUMPING APPARATUS

[75] Inventor: Dorian F. Mowbray, Burnham, England

[73] Assignee: Lucas Industries Limited, Birmingham, England

[21] Appl. No.: 787,520

[22] Filed: Apr. 14, 1977

[30] Foreign Application Priority Data

Apr. 20, 1976 [GB] United Kingdom ..... 15889/76

[51] Int. Cl.[2] ..... F02M 45/06

[52] U.S. Cl. ..... 123/139 E; 123/32 G; 417/251

[58] Field of Search ..... 123/139 AL, 139 BC, 123/139 BD, 139 E, 32 F, 32 G; 417/250, 251, 252, 253, 462

[56] References Cited

U.S. PATENT DOCUMENTS

| | | | |
|---|---|---|---|
| 2,946,292 | 7/1960 | Chmielecki | 123/139 BC |
| 3,228,339 | 1/1966 | Evans et al. | 123/139 AL |
| 3,489,093 | 1/1970 | Thornber | 123/139 AL |
| 3,498,226 | 3/1970 | Mowbray | 417/253 |
| 3,752,137 | 8/1973 | Kimberly | 123/32 G |
| 3,759,239 | 9/1973 | Regneault et al. | 123/32 F |

FOREIGN PATENT DOCUMENTS

| | | | |
|---|---|---|---|
| 1919707 | 11/1970 | Fed. Rep. of Germany | 123/139 AL |
| 2303170 | 3/1976 | France | 123/139 E |

*Primary Examiner*—Charles J. Myhre
*Assistant Examiner*—Andrew M. Dolinar

[57] ABSTRACT

A fuel pumping apparatus for supplying fuel to a compression ignition engine comprises a rotary distributor located within a housing and having a transverse bore mounting a pair of plungers which are driven inwardly as the distributor rotates, to displace fuel through an outlet. The apparatus includes a pilot pump including a plunger which is operable by actuating means to displace fuel from a pilot pump chamber in advance of the delivery of fuel by the main plungers. The displacement of fuel by the pilot plunger effects an initial supply of fuel to the engine for the purpose of pilot injection.

5 Claims, 3 Drawing Figures

LIQUID FUEL PUMPING APPARATUS

This invention relates to liquid fuel pumping apparatus for supplying liquid fuel to a compression ignition engine and of the kind comprising a rotary distributor member located within a housing, a bore formed in the distributor member, a plunger in the bore, a cam ring having cam lobes for imparting inward movement to the plunger as the distributor member rotates, inlet port means in the distributor member and housing and through which fuel can be supplied to the pump chamber defined by the plunger and the bore, stop means to limit the outward movement of the plunger as fuel is supplied to the pump chamber, and outlet port means in the distributor member and housing and through which fuel displaced from the pump chamber flows during inward movement of the plunger, said outlet port means including an outlet which in use is connected to a fuel injection nozzle of the associated engine.

It is known that the operation of a compression ignition engine can be improved by supplying a small quantity of the total charge of fuel to the engine slightly earlier than the main quantity of fuel. The technique is known as pilot injection and the object of the present invention is to provide an apparatus of the kind specified in a form in which pilot injection can be achieved.

According to the invention an apparatus of the kind specified comprises a pilot pump having a pump chamber in communication with said bore, electrically operated actuating means for said pilot pump and means for supplying a control signal to said actuating means whereby said pilot pump supplies a limited quantity of fuel to the outlet in advance of the main quantity of fuel supplied by said plunger.

One example of a liquid fuel pumping apparatus in accordance with the invention will now be described with reference to the accompanying drawings in which.

Figure 1:
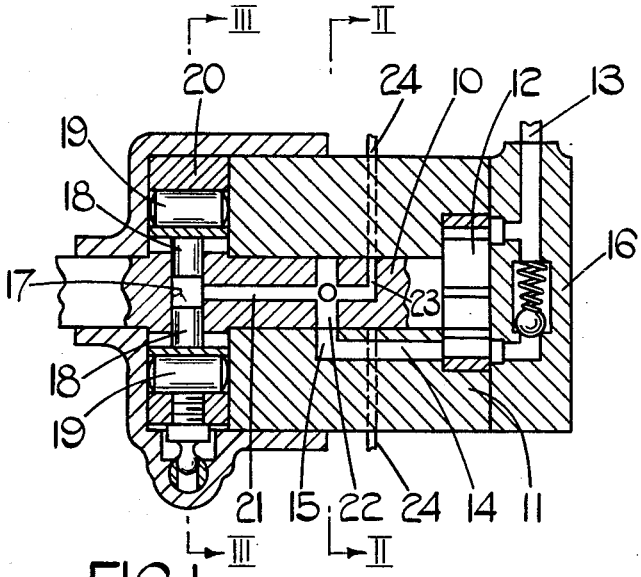
FIG. 1 is a sectional side elevation of one example of an apparatus to which the invention may be applied.

Referring to FIG. 1 of the drawings the apparatus comprises a rotary distributor member 10 which is located within a housing 11. The distributor member is adapted to be driven in timed relationship with the engine with which the apparatus is associated. At one end of the distributor member is the rotary part of a fuel feed pump 12 having an inlet 13 which in use is connected to a source of fuel. The outlet of the feed pump communicates with a passage 14 extending within the housing and terminating in an inlet port 15 opening on to the periphery of the distributor member. The output pressure of the feed pump is controlled by a valve conveniently so that the pressure rises as the speed of operation of the associated engine rises.

Formed in the distributor member is a transversely extending bore 17 in which is mounted a pair of plungers 18. The outer ends of the plungers bear against shoes which mount rollers 19 and the rollers 19 co-operate with the internal peripheral surface of an annular cam ring 20 located within the housing. The internal peripheral surface of the cam ring is provided with a plurality of pairs of cam lobes **20*a* which as the distributor member rotates, impart simultaneous inward movement to the plungers 18**.

The portion of the bore 17 disposed intermediate the plungers 18 communicates with a passage 21 formed in the distributor member and communicating at one position, with a plurality of inlet passages 22. The inlet passages 22 are positioned to register in turn as the distributor member rotates, with the inlet port 15. The passage 21 also communicates with a radially disposed delivery passage 23 which opens on to the periphery of the distributor member for registration in turn with a plurality of outlets 24 formed in the housing and which in use, are connected to the injection nozzles of the associated engine respectively.

In operation fuel is supplied to the bore 17 to effect outward movement of the plungers during the time the port 15 is in communication with one of the inlet passages 22. During this time the delivery passage 23 is out of register with an outlet. As the distributor member continues to rotate the communication between the port 15 and an inlet passage 22 is broken and the delivery passage 23 is moved into register with an outlet 24. As soon as this communication is established the plungers 18 can be moved inwardly and during such inward movement fuel is displaced from the bore 17 to one of the outlets 24 and thence to the respective injection nozzle.

The extent of outward movement of the plungers 18 is determined by means of a stop and at each filling stroke the plungers are moved into contact with the stop. The stop may be adjustable so as to be able to determine the amount of fuel delivered to the engine or it may be a fixed stop and some other means provided to control the amount of fuel which is delivered to the engine for example some means which spills fuel during the delivery of fuel by the plungers.

Figure 2:
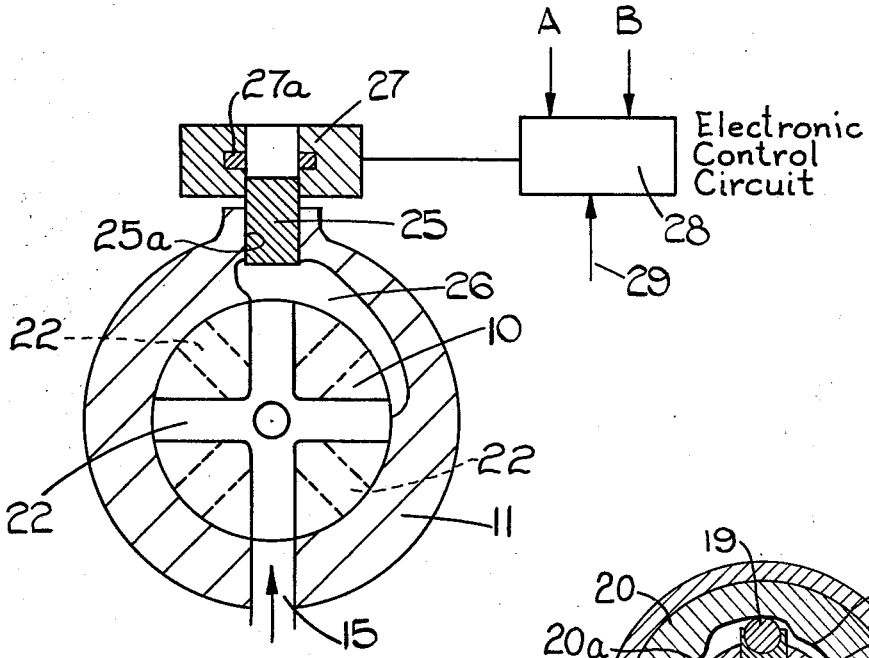
FIG. 2 shows how the apparatus shown in FIG. 1 is adapted to provide pilot injection.
Figure 3:
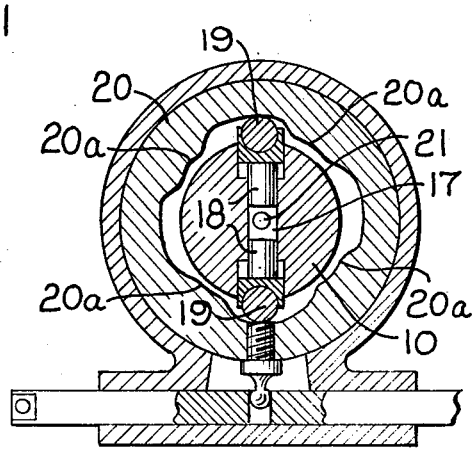
FIG. 3 is a section taken along the line III—III of FIG. 1.

In order to provide for pilot injection of fuel the apparatus as described is modified as shown in FIG. 2. A pilot pump plunger 25 is provided which is conveniently accommodated within a suitably disposed bore **25*a* in the housing 11. The inner end of the bore 25*a* communicates at all times with the passage 21 conveniently by way of the passages 22. This being achieved by a recess 26 formed in the housing. The plunger 25 is operated by means of an electrically operated actuating means 27. This actuating means may be a stack of piezoelectric crystals or it may comprise a solenoid and armature combination 27*a*. Electric power in the form of a control signal is provided to the actuating means by means of an electronic control circuit 28 which receives a signal 29 indicative of the position of the distributor member 10. The arrangement is such that before the plungers 18 are moved inwardly by a pair of cam lobes 20*a*, the plunger 25 is moved inwardly by the actuating means 27. The effect of this which takes place while the delivery passage 23 is in register with a delivery port 24, is that a pilot quantity of fuel is supplied to the outlet 24 which is in register with the passage 23**.

The amount of fuel depends upon the stroke of the plunger 25 and its cross sectional area but the pilot quantity of fuel will be less than the main quantity of fuel and it can be arranged that the stroke of the plunger 25 is adjustable. The plunger 25 conveniently is maintained in its inner most position while the plungers 18 are moved inwardly and then all the plungers can be moved outwardly when the port 15 registers with an inlet passage 22. Alternatively the plunger 25 can be arranged to move outwardly at the end of the inward movement of the plungers 18 thereby to reduce the pressure in the various passages within the distributor member and in particular the pipe lines interconnecting the outlet with the injection nozzle. Such reduction in pressure allows rapid closure of the valve in the injection nozzle.

The timing of the pilot injection of fuel in relation to the main injection of fuel can be varied by means of the electronic control circuit, in accordance with the speed at which the apparatus is driven and also in accordance with the amount of fuel which is being supplied by the apparatus. Two signals indicative of these quantities are provided to the electronic control circuit 28 for this purpose, such signals being indicated by the arrows A and B.

I claim:

1. A liquid fuel pumping apparatus for supplying liquid fuel to a compression ignition engine and of the kind comprising a rotary distributor member located within a housing, a bore formed in the distributor member, a plunger in the bore, said plunger and said bore defining a pump chamber, a cam ring having cam lobes for imparting inward movement to the plunger as the distributor member rotates, inlet port means in the distributor member and housing and through which fuel can be supplied to said pump chamber, outlet port means in the distributor member and housing and through which fuel displaced from the pump chamber flows during inward movement of the plunger, said outlet port means including an outlet, a pilot pump having a pump chamber in communication with said bore, electrically operated actuating means for said pilot pump and means for supplying a control signal to said actuating means whereby said pilot pump supplies a limited quantity of fuel to the outlet in advance of the main quantity of fuel supplied by said plunger.

2. An apparatus according to claim 1 in which said pump chamber is defined in the housing, the pilot pump also including a pilot plunger movable by said actuating means.

3. An apparatus according to claim 2 in which said inlet port means includes an inlet port in the housing in communication with a source of fuel and a plurality of inlet passages in the distributor member which register in turn with said inlet port to permit fuel to flow to said pump chambers.

4. An apparatus according to claim 3 in which said chamber opens onto the periphery of the distributor member so that it is in communication at all times with at least one of said inlet passages.

5. An apparatus according to claim 4 including a control circuit for controlling the operation of said actuating means.

* * * * *